US008657980B2

(12) United States Patent
Piroli

(10) Patent No.: US 8,657,980 B2
(45) Date of Patent: Feb. 25, 2014

(54) PROCESS FOR MAKING A GLASS BRICK AND BRICK OBTAINED BY SAID PROCESS

(75) Inventor: Giovanni Piroli, Calcinaia (IT)

(73) Assignee: BNP Paribas S.A., Paris (FR)

( * ) Notice: Subject to any disclaimer, the term of this patent is extended or adjusted under 35 U.S.C. 154(b) by 0 days.

(21) Appl. No.: 13/319,420

(22) PCT Filed: May 6, 2010

(86) PCT No.: PCT/IB2010/051995
§ 371 (c)(1),
(2), (4) Date: Nov. 30, 2011

(87) PCT Pub. No.: WO2010/131165
PCT Pub. Date: Nov. 18, 2010

(65) Prior Publication Data

US 2012/0167506 A1 Jul. 5, 2012

(30) Foreign Application Priority Data

May 15, 2009 (IT) ..... FI2009A0108

(51) Int. Cl.
*B32B 37/12* (2006.01)

(52) U.S. Cl.
USPC ..... 156/145

(58) Field of Classification Search
USPC ..... 156/145, 99, 109, 250, 256, 272.2, 156/275.7
See application file for complete search history.

(56) References Cited

U.S. PATENT DOCUMENTS

| | | | | |
|---|---|---|---|---|
| 5,446,634 | A | 8/1995 | Okubo | |
| 6,802,162 | B1 * | 10/2004 | Fisher | 52/306 |
| 2002/0189743 | A1 * | 12/2002 | Hornung et al. | 156/109 |
| 2004/0163759 | A1 * | 8/2004 | Wilkinson | 156/254 |
| 2005/0000174 | A1 | 1/2005 | Wirawan | |
| 2007/0081228 | A1 | 4/2007 | Hartig | |

FOREIGN PATENT DOCUMENTS

| | | | | |
|---|---|---|---|---|
| DE | 702 410 | C | | 2/1941 |
| DE | 2830504 | A | * | 1/1980 |
| DE | 10 2005 024557 | A1 | | 12/2006 |
| EP | 853168 | A2 | * | 7/1998 |
| JP | 4 175237 | A | | 6/1992 |
| JP | 11079767 | A | * | 3/1999 |
| JP | 11287013 | A | * | 10/1999 |
| WO | 2008/033948 | A | | 3/2008 |

OTHER PUBLICATIONS

Machine Translation of DE 2830504 A, Jan. 1980.*
Machine Translation of EP 853168 A2, Jul. 1998.*

* cited by examiner

*Primary Examiner* — Daniel McNally
(74) *Attorney, Agent, or Firm* — Lucas & Mercanti, LLP

(57) ABSTRACT

A process for making a brick comprises the steps of prearranging at least one pair of half-shells (3*a*, 3*b*) and fixing said half-shells (3*a*, 3*b*) to each other to define a main body (2) of the brick with a cavity {4} therein. The process further comprises the step of introducing a preset quantity of argon into said cavity (4), A brick comprises a pair of half-shells (3*a*, 3*b*) fixed to each other to define a main body (2) of said brick (1); said main body (2) exhibits an inner cavity (4); said cavity (4) holds a preset quantity of argon.

6 Claims, 3 Drawing Sheets

PROCESS FOR MAKING A GLASS BRICK AND BRICK OBTAINED BY SAID PROCESS

CROSS-REFERENCE TO RELATED APPLICATIONS

This application is a 371 of PCT/IB2010/051995, filed May 6, 2010, which claims the benefit of Italian Patent Application No. FI2009A000108, filed May 15, 2009, the contents of each of which are incorporated herein by reference.

TECHNICAL FIELD OF THE INVENTION

The object of the present invention is a process for making a glass brick and a brick made by said process. In particular, the present invention refers to a glass brick for the formation of concrete-and-glass walls.

The bricks of known type comprise a main body of substantially prismatic shape defined by two substantially equal half-shells joined to each other.

STATE-OF-THE-ART

As it is known, a cavity is formed inside the main body that isolates thermally two environments between which the brick in question is located.

To improve the isolating capacity of the known bricks, a sheet may be received within said cavity, which sheet is able to reflect at least a portion of incident infrared radiation striking the brick and the sheet as well.

Said sheet, generally referred to as "low-emittance sheet", comprises a glass plate coated with a layer of metal material.

In greater detail, the sheet is connected to both the half-shells in correspondence of their peripheral edges.

The bricks of known type are constructed by firstly producing the two half-shells from glass, and then coupling them by the interposition of a suitable adhesive material.

In case the known brick is provided with the said reflecting sheet, the latter is disposed between the half-shells concomitantly to the coupling thereof.

Preliminarily, however, in correspondence of the perimetral edges of the half-shells, a cut is made which defines a coupling step for the reflecting sheet.

In greater detail, the steps of the two half-shells define between them a seat for receiving the sheet.

The Applicant has found that the isolating capacity of the known bricks is sometimes not fully satisfactory and it could be improved.

DETAILED DESCRIPTION

In this context, the object of the present invention is to provide a process for making a glass brick and a brick, made by said process, having improved thermal-isolation capacity. A further object of the present invention is to provide a process for making a glass brick and a brick made by said process with simpler production requirements.

The indicated technical task and the specified objects are substantially achieved by a process for making a glass brick including the technical characteristics disclosed in one or more of the appended claims, and by a brick, made by said process.

These and other objects of the present invention will appear more clearly by a reading of the indicative, and thus non-limitative, description of a preferred, but non-exclusive, embodiment of a process for making a brick, and a brick made by said process of simpler production requirements, as illustrated in the accompanying drawings, wherein.

In the accompanying figures, numeral 1 designates as a whole a glass brick according to the present invention.

The brick 1 comprises a main body 2 made from transparent material. Preferably, such material is glass.

Advantageously, the main body 2 exhibits a substantially parallelepiped shape with a square base.

In an alternative embodiment (not shown), the main body 2 has a substantially parallelepiped shape with a rectangular base.

In further embodiments (not shown), such main body 2 may have a prismatic shape, for example with a polygonal base.

The main body 2 comprises at least two half-shells 3*a*, 3*b* coupled to each other so as to define the same main body 2.

The half-shells 3*a*, 3*b* are mutually fixed in a way to be described below in greater detail.

Figure 2:
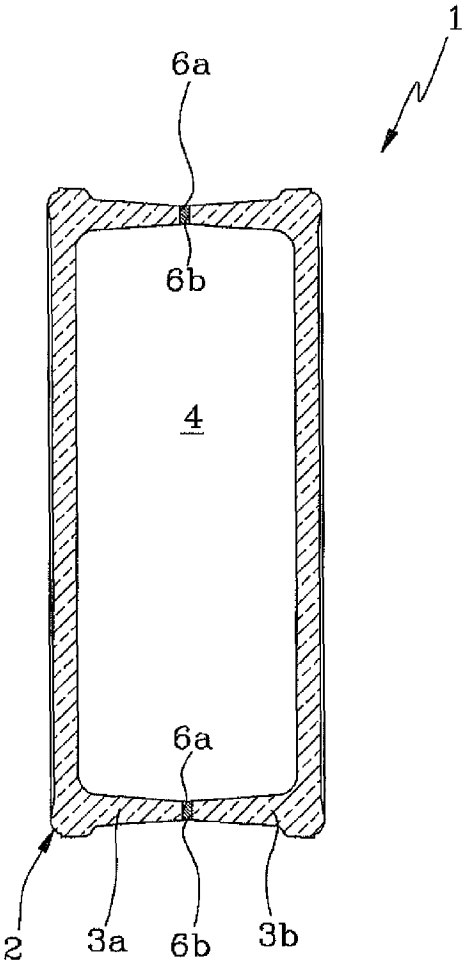
FIG. 2 is a section view of a first embodiment of the brick of FIG. 1.

In particular, the half-shells 3*a*, 3*b* are shaped in such a way that, once coupled to each other, define a closed cavity 4 inside the main body 2 (FIG. 2).

Advantageously, the cavity 4 is filled with a preset quantity of argon.

The latter is a noble gas characterized by high availability and optimal thermal isolation capacity. By way of example, the argon has a coefficient of thermal conductivity of 0.018 W/(m*K), whereas the air has a coefficient of thermal conductivity of 0.026 W/(m*K).

In the preferred embodiment, the quantity of argon held in the cavity 4 of brick 1 can be at the atmospheric pressure. However, in alternative embodiments, such quantity of argon is at pressures other than the atmospheric one. Advantageously, the pressure of said quantity of argon is less than the atmospheric pressure so as to further minimize the conduction of heat through the brick 1.

Figure 1:
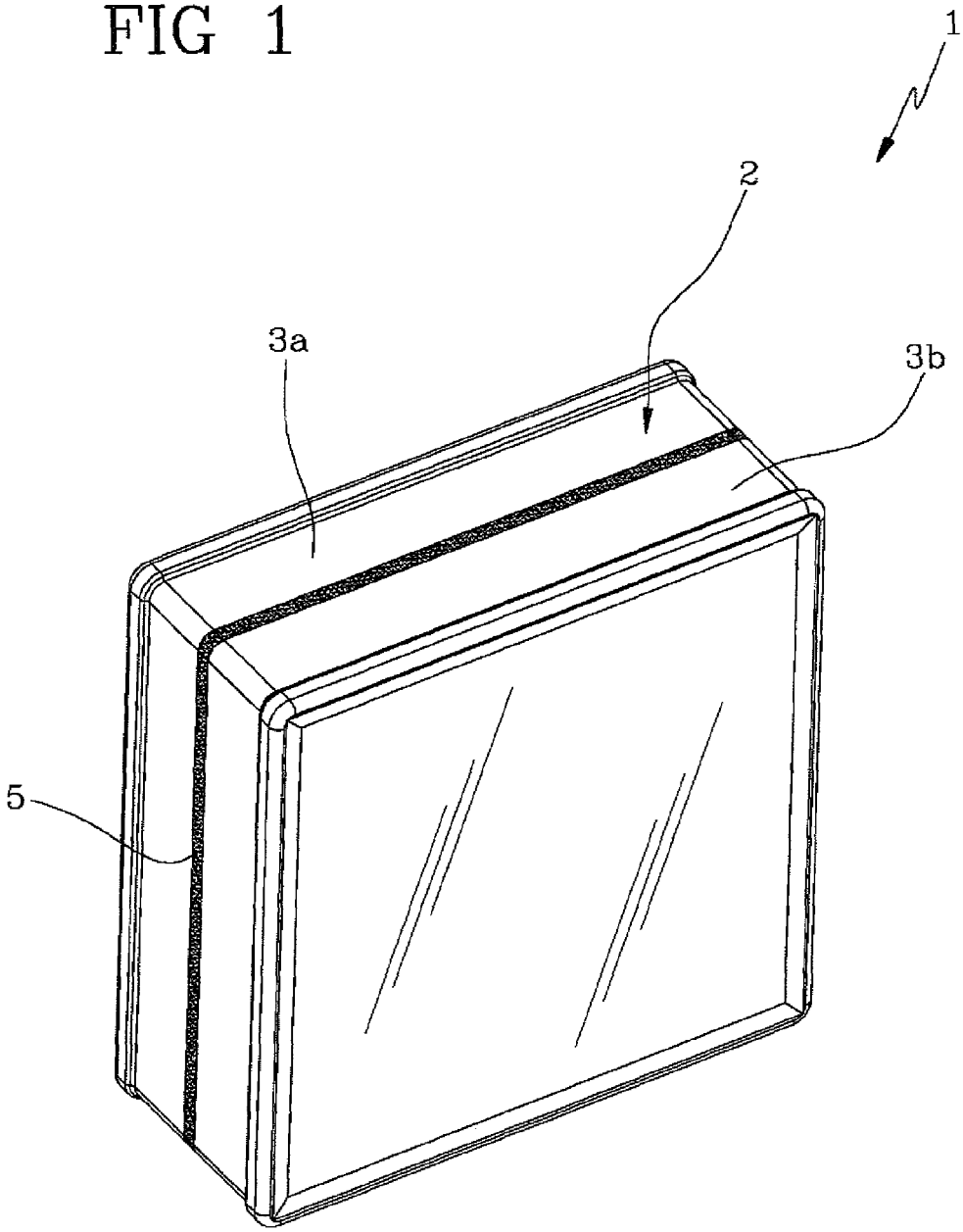
FIG. 1 is a perspective view of a brick according to the invention.
Figure 3:
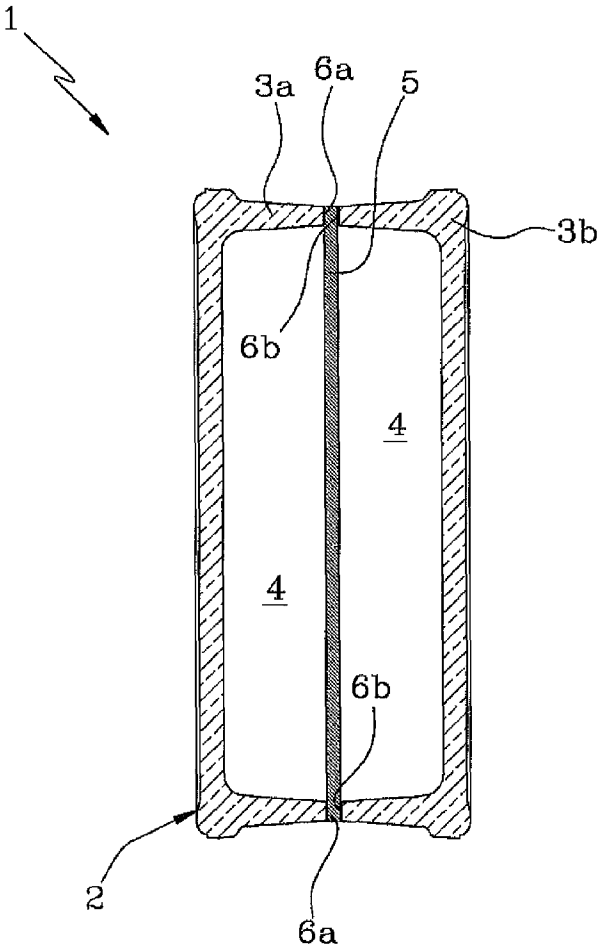
FIG. 3 is a section view of a second embodiment of the brick of FIG. 2.

Preferably, the glass brick 1 also comprises a reflecting sheet 5 which reflects at least a portion of incident infrared radiation striking the brick 1 and, consequently, the sheet 5. With reference to FIG. 3, the reflecting sheet 5 is located between the half-shells 3*a*, 3*b*.

In other words, the reflecting sheet 5 is inside the cavity 4 and divides the latter into two separate portions both of which contain argon.

To this end, the half-shells 3*a*, 3*b* comprise respective peripheral edges 6*a*, 6*b* which, when the half-shells 3*a*, 3*b* are coupled to each other, result in facing relationship.

Advantageously, the edges 6*a*, 6*b* are quite flat and lie completely in contact with the sheet 5 when the half-shells 3*a*, 3*b* are coupled to each other.

Consequently, the connection between the half-shells 3*a*, 3*b* and the sheet 5 is definitely simplified inasmuch as it is obtained solely through the coupling of flat surfaces.

As far as the reflecting sheet 5 is concerned, this is made up of a plate of transparent material, preferably glass, a coating layer of metal material being deposited on at least one side of the plate.

Said coating is formed in such a way as to allow the light to pass through and the electromagnetic infrared radiation which strikes the said sheet 5 to reflect therefrom at least partially.

With specific reference to the coupling of half-shells 3*a*, 3*b* and sheet 5, this is made by using a suitable adhesive material disposed between each half-shell 3*a*, 3*b* and the sheet 5.

Such adhesive material must be radiated with ultraviolet radiation to allow the polimerization thereof. By way of example only, such adhesive material is a methacrylic urethane resin which, among other things, maintains good characteristics of transparency also after polimerization.

Figure 4:
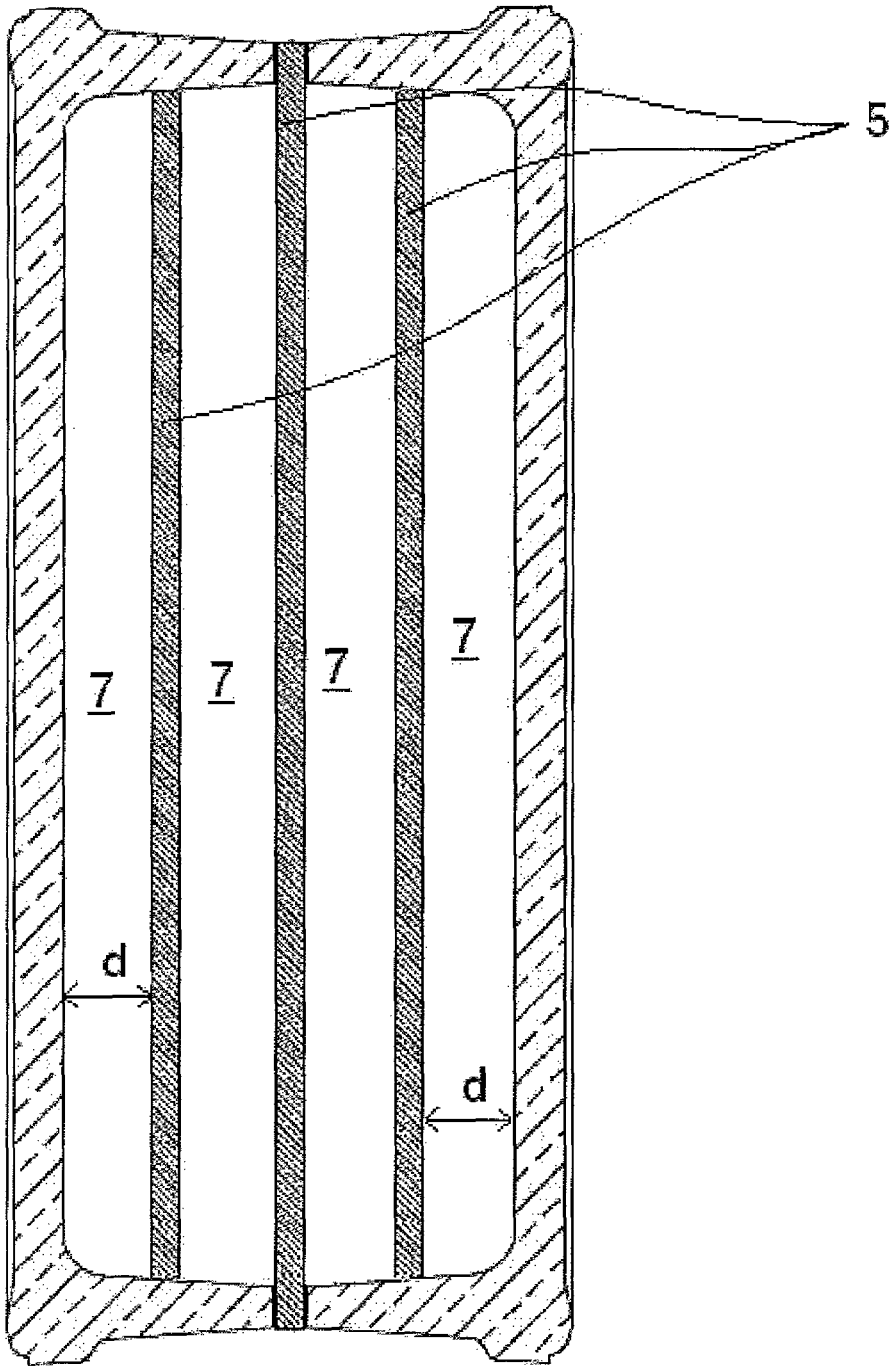
FIG. 4 is a section view of a third embodiment of the brick according to the present invention.

With reference to FIG. 4, a third embodiment of the brick according to the present invention is now described, wherein said brick may comprise a plurality of sheets 5 so as to obtain a predetermined number of gaps 7 inside the cavity 4.

According to the present invention, the described brick 1 is formed by the process illustrated below.

The process for making the brick 1, according to what has been illustrated above, comprises the preliminary step of prearranging the half-shells 3*a*, 3*b*.

Such step may be carried out by producing directly the half-shells 3*a*, 3*b* by stamping a predetermined amount of melten glass, for example.

In alternative embodiments, such step of prearranging the half-shells 3*a*, 3*b* is carried out by cutting in two a main body 2 already formed.

Once the half-shells 3*a*, 3*b* are predisposed, these are fixed to each other to form the main body 2 of brick 1 and to consequently define the cavity 4.

According to the present invention, the process further comprises the step of introducing the said predetermined quantity of argon into the cavity 4.

Preferably, the introduction of the argon is made concomitantly to fixing the half-shells 3*a*, 3*b* to each other. In other words, the fixing—to be described below more clearly—is performed in a confined environment under a modified atmosphere, that is, in the presence of argon only. In this way, the argon present between the half-shells 3*a*, 3*b* moving close to each other remains trapped within the cavity 4 defined by the mutual contact of the half-shells 3*a*, 3*b*.

In alternative embodiments (not described any further), the introduction of argon is subsequent to the fixing of the half-shells 3*a*, 3*b* and, therefore, to the formation of cavity 4.

Moreover, in a further embodiment (not shown), the introduction of argon into the cavity 4 is performed at a pressure below the atmospheric one. According to the above, this allows a further reduction of heat transfer through the brick 1.

Preferably, the described process also comprises the step of prearranging the reflecting sheet 5 and interposing it between the half-shells 3*a*, 3*b*.

In greater detail, the reflecting sheet 5 is disposed between the half-shells 3*a*, 3*b* prior to the fixing thereof. Moreover, the reflecting sheet 5 is connected to the half-shells 3*a*, 3*b* concomitantly to the step of fixing the same half-shells 3*a*, 3*b* to each other.

In particular, the reflecting sheet 5 is fixed to one of the half-shells 3*a*. Thereafter, the concerned half-shell 3*a* and the reflecting sheet 5 are fixed to the other half-shell 3*b*.

As above mentioned, the sheet 5 is constructed by prearranging the glass plate and covering at least one side thereof with a preferably metal coating, that is, with a coating apt to improve its thermo-isolating properties.

Advantageously, before coupling the reflecting sheet 5 with the half-shells 3*a*, 3*b*, provision is made for removing the reflecting metal coating along the peripheral edge of sheet 5.

Both the mutual coupling of half-shells 3*a*, 3*b* and the fixing of the latter with the reflecting sheet 5 are preferably carried out by affixing a preset quantity of adhesive material above mentioned.

Once the half-shells 3*a*, 3*b* are brought close to each other—and to the reflecting sheet 5, if any—and the adhesive material has been applied, the brick 1 being formed is irradiated with ultraviolet radiation to cause the polymerization of the adhesive material and, thereby, the fixed coupling of said components to each other.

By way of example, such radiation is carried out by means of at least one UV source of high intensity. In particular, the radiation used has a wavelength in the range of 365 nm to 420 nm.

Preferably, such radiation step has a length ranging from 3 s to 15 s, preferably from 6 s to 10 s.

The invention reaches the proposed object and achieves major advantages.

In fact, the use of argon as a filler inside the brick's cavity makes it possible to obtain a significant reduction of heat transfer owing to the very isolating properties of this noble gas.

Besides, the contemporary use of at least one reflecting sheet allows a portion of the incident thermal energy striking the brick to be reflected as infrared radiation.

The insertion of at least one sheet 5 into the cavity 4, allows the reduction of the distance "d" between two adjacent faces (whether they are the walls of half-shells or of sheets 5) which form a gap 7, so as to increase the number of modalities of heat-transfer exchange and, therefore, to improve the whole thermo-isolating capacity of brick 1.

It is known, in fact, that the exchange of heat through the walls of half-shells and of internal sheets 5, takes place by conduction, whereas, within the gaps 7, it takes place by convection.

More specifically, the higher the number of sheets 5 introduced inside the bricks 1, the higher the number of gaps 7 being formed and, therefore, the number of modalities of heat-transfer exchange to which the radiation will be subjected.

Advantageously, moreover, the reduction of distance "d" allows the obtainment of a significant reduction of thermal fluxes, according to the laws of physics concerning the exchange of heat by convection.

Moreover, as the fixing of the said components is made by coupling adjacent flat surfaces, the assembling of the brick results simplified.

The invention claimed is:

1. Process for making a brick, comprising the steps of:

a) prearranging at least one pair of half-shells, each half-shell having an interior wall;

b) fixing said half-shells to each other to define a main body of said brick with a cavity therein; and c) introducing a preset quantity of argon into said cavity;

d) prearranging at least one reflecting sheet and locating said at least one reflecting sheet between said half-shells, wherein said at least one reflecting sheet reflects a portion of incident infrared radiation, the step of prearranging least one reflecting sheet comprises fixing said reflecting sheet to one of said half-shells and fixing said other half-shell to said reflecting sheet thereby forming said brick; and e) prior to fixing said half-shells to form said brick, prearranging at least one additional reflecting sheet inside each half-shell spaced from said interior wall to provide said brick with a plurality of spaced reflecting sheets in said cavity thereby increasing the thermal insulation while maintaining structural rigidity.

2. Process according to claim 1, wherein said step of introducing a quantity of argon into the cavity is performed at the same time as the step of fixing said half-shells.

3. Process according to claim 1, wherein the step of prearranging said at least one reflecting sheet comprises the steps of prearranging a glass plate and covering said plate with a coating able to improve the thermoinsulating characteristics and infrared radiation reflecting-capacity thereof.

4. Process according to claim 1, wherein the step of prearranging said half-shells comprises the step of prearranging a main body preformed and the step of cutting said main body preformed within said pair of half-shells.

5. Process according to claim 1, wherein the step of fixing the half-shells comprises the steps of disposing a preset quantity of adhesive material between said half-shells and irradiating said half-shells with ultraviolet radiation.

6. Process according to claim 1, wherein said preset quantity of argon is introduced into said cavity at a pressure lower than the atmospheric pressure.

* * * * *

UNITED STATES PATENT AND TRADEMARK OFFICE

CERTIFICATE OF CORRECTION

PATENT NO. : 8,657,980 B2
APPLICATION NO. : 13/319420
DATED : February 25, 2014
INVENTOR(S) : Giovanni Piroli It is certified that error appears in the above-identified patent and that said Letters Patent is hereby corrected as shown below:

Item (73) on the Title page of the patent should appear as follows:
(73) Assignee: SEVES S.P.A., Firenze (IT)

Signed and Sealed this
Eighteenth Day of November, 2014

Michelle K. Lee

Michelle K. Lee
*Deputy Director of the United States Patent and Trademark Office*